US005446385A

United States Patent [19]

Kugler et al.

[11] Patent Number: 5,446,385

[45] Date of Patent: Aug. 29, 1995

[54] IGNITION SYSTEM FOR INTERNAL COMBUSTION ENGINES

[75] Inventors: Karl-Heinz Kugler, Vaihingen; Walter Gollin, Moeglingen; Christian Zimmermann, Pleidelsheim, all of Germany

[73] Assignee: Robert Bosch GmbH, Stuttgart, Germany

[21] Appl. No.: 244,445

[22] PCT Filed: Sep. 8, 1993

[86] PCT No.: PCT/DE93/00817

§ 371 Date: Jun. 2, 1994

§ 102(e) Date: Jun. 2, 1994

[87] PCT Pub. No.: WO94/08133

PCT Pub. Date: Apr. 14, 1994

[30] Foreign Application Priority Data

Oct. 2, 1992 [DE] Germany ..... 42 33 211.7

[51] Int. Cl.[6] ..... F02P 17/00

[52] U.S. Cl. ..... 324/388; 324/378; 324/380; 123/644; 315/209 T

[58] Field of Search ..... 324/378, 380, 388; 123/644; 315/209 T

[56] References Cited

U.S. PATENT DOCUMENTS

| | | | |
|---|---|---|---|
| 3,749,974 | 7/1973 | Kissel | 315/209 T |
| 4,077,379 | 3/1978 | Jundt et al. | 315/209 T X |
| 4,285,323 | 8/1981 | Sugiura et al. | 123/638 |
| 4,413,192 | 11/1983 | Niemetz | 307/278 |
| 4,912,373 | 3/1990 | Moreau | 315/209 T |
| 4,913,123 | 4/1990 | DeBiasi et al. | 123/609 |
| 5,043,633 | 8/1991 | Perkins | 315/209 T |

FOREIGN PATENT DOCUMENTS

| | | |
|---|---|---|
| 0040260 | 11/1981 | European Pat. Off. . |
| 2339896 | 2/1975 | Germany . |
| 2265344 | 11/1977 | Germany . |
| 2842923 | 4/1979 | Germany . |
| 2811149 | 9/1979 | Germany . |
| 60-147571 | 8/1985 | Japan . |
| 1589807 | 5/1981 | United Kingdom . |

OTHER PUBLICATIONS

2244 Research Disclosure (1988) Aug., No. 292, New York, N.Y., USA.

*Primary Examiner*—Kenneth A. Wieder
*Assistant Examiner*—Glenn W. Brown
*Attorney, Agent, or Firm*—Kenyon & Kenyon

[57] ABSTRACT

An ignition system for internal combustion engines serves as a bracket circuit arrangement (10, 11, 12, 16) to limit the primary voltage, in order to protect parts energized with high voltage from being destroyed. The ignition system comprises a voltage bracketing of the ignition transistor (3), the bracketing voltage being variable in dependence upon a secondary-side load. The primary voltage ($U_P$) is acquired by an evaluation unit (9) and, given a high secondary load, a high bracketing voltage is used and, given a low secondary load, a low bracketing voltage is used.

6 Claims, 3 Drawing Sheets

| | C-6 | R-7 | tr 0...200V | $dU_1$ 0...25 µs | $dU_2$ 0...50 µs |
|---|---|---|---|---|---|
| a | 120 pF | — | 36 µs | 140 V | 262 V |
| | " | — | 38 µs | 130 V | 262 V |
| | " | — | 39 µs | 125 V | 240 V |
| | " | 1M | 40 µs | 130 V | 242 V |
| | " | 1M | 42 µs | 125 V | 230 V |
| | " | 1M | 43 µs | 115 V | 225 V |
| b | 50 pF | — | 23 µs | 210 V | 390 V |
| | " | — | 25 µs | 200 V | 300 V |
| | " | — | 27 µs | 185 V | 250 V |
| | " | 1M | 25 µs | 200 V | 330 V |
| | " | 1M | 27 µs | 190 V | 300 V |
| | " | 1M | 28 µs | 180 V | 250 V |

Fig.2

IGNITION SYSTEM FOR INTERNAL COMBUSTION ENGINES

BACKGROUND OF THE INVENTION

German Published Patent Application 23 39 896 shows a circuit including an element having a specific breakdown voltage coupled to the control electrode of the switching transistor in the primary circuit between the primary winding and the contact-break distance of the ignition transistor. If the voltage exceeds a permissible value when the contact-break distance of the ignition transistor makes the transition to the nonconducting state, then the voltage at the element having a specific breakdown voltage breaks through, and a control current begins to flow across the control path of the ignition transistor, which control current again makes the emitter-collector path of the ignition transistor somewhat permeable to current. As a result, the voltage at the contact-break distance of the ignition transistor drops again, and, in fact, continues to drop until the voltage at the switching element having a specific breakdown voltage falls below this breakdown voltage. This configuration comprising the element having a fixed breakdown voltage (Zener diode) cannot ensure overvoltage protection for all operating ranges. For example, if one designs the ignition system and, thus, the element having a specific breakdown voltage, so as to allow an adequate secondary voltage to still be provided for all operating states, given a large secondary load, then larger values can occur on the parts energized with high voltage, given a low secondary load. Such an overloading can lead to their destruction, when, for example, a spark plug connector drops out and a breakdown occurs across the high-voltage insulation.

As such, conventional systems work with a fixed primary Zener-type characteristic as a voltage bracketing of the ignition transistor and, thus, do not provide a satisfactory compromise between a sufficient secondary voltage supply and high-voltage strength of the parts that are energized with high voltage.

SUMMARY OF THE INVENTION

In accordance with the present invention, an ignition system for an internal combustion engine includes an ignition coil and an ignition output stage in the primary circuit of the ignition coil. Current through the primary circuit, and as a result a voltage at the secondary winding at the ignition spark, is dependent upon a bracketing voltage of a bracketed circuit arrangement. The bracketing voltage is dependent upon a primary voltage and an output of an evaluation unit which are coupled to the bracketing circuit arrangement. The evaluation unit monitors the primary voltage to determine whether the ignition coil has a high secondary load or a low secondary load. The evaluation circuit then induces a high bracketing voltage on the bracket circuit arrangement if it determines that there is a high secondary load and induces a low bracketing voltage on the bracket circuit arrangement if it determines that there is a low secondary load.

It is particularly advantageous that an optimal voltage value is made available in each case for an ignition spark by evaluating the rise time of the primary voltage. Furthermore, it is especially advantageous that the voltage reached in the primary winding after expiration of a specifiable time is able to be evaluated as a measure for the secondary load. Thus, one can react immediately to altered operational conditions.

Finally, the advantage of detecting the load acting on the secondary side is that this provides an indication of the available ignition voltage supply. Thus, for example, the rise time of the primary voltage or the attainment of a predetermined primary voltage value within a specifiable time can be evaluated as a measure for the ignition-voltage supply. Another advantage of this primary-side acquisition of the ignition-voltage supply on the secondary side of the ignition coil is that it can be drawn upon during normal operation of the engine for diagnostic evaluation, to recognize possible errors in the ignition system. Thus, a flat rise in the secondary voltage is an indication that a spark plug connector is exhibiting shunt firing. If, on the other hand, the detected spark duration is less than a limiting value, or rather if the spark voltage characteristic typical of combustion is absent, then an ignitable mixture is lacking, for example, or an ignition spark is possibly lacking at the spark plug due to a spark plug connector that has dropped out.

It is possible to detect the actual high voltage being provided, for example, by removing a spark plug connector and making appropriate measurements, however this is not practical during operation of the internal combustion engine. In this case, the evaluation as described above offers a simple solution for detecting ignition voltage.

BRIEF DESCRIPTION OF THE DRAWINGS

FIG. 2 illustrates the relationship between the secondary load and the rise characteristic of the primary voltage.

DETAILED DESCRIPTION OF THE INVENTION

Figure 1:
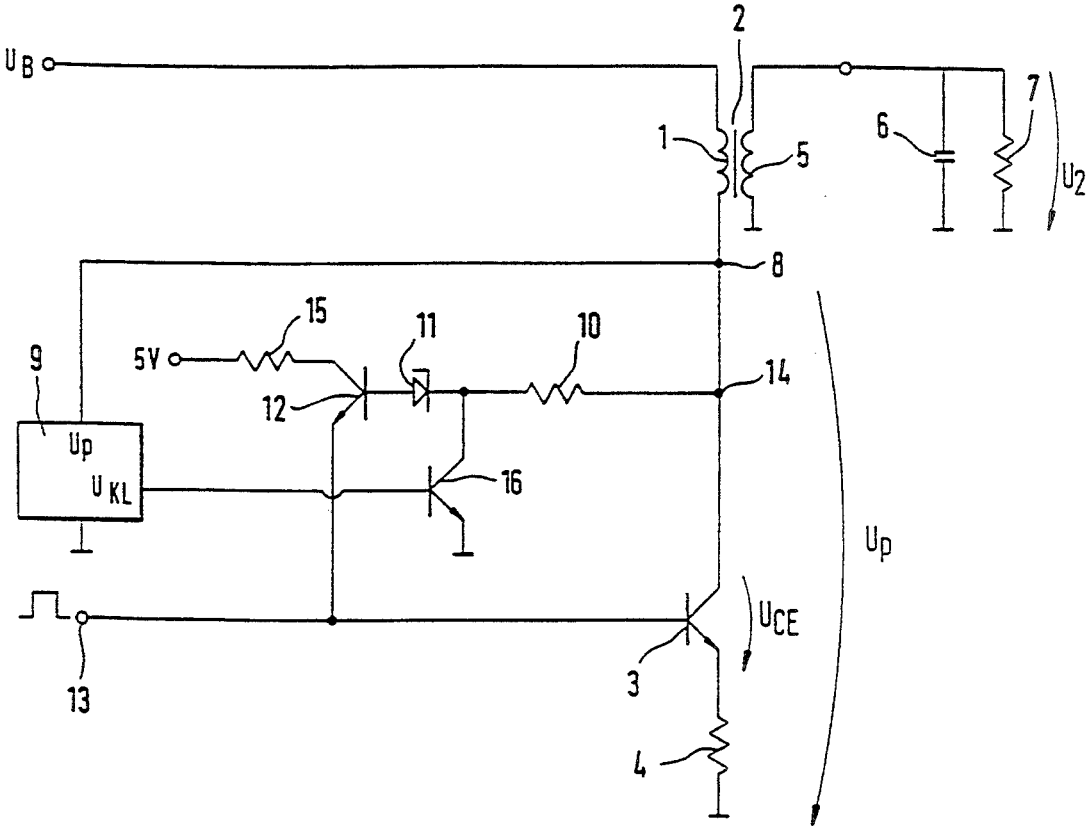
FIG. 1 shows the basic structure of a variable output-stage Zener-type characteristic in accordance with the present invention.

FIG. 1 depicts an ignition device in accordance with the present invention for an internal combustion engine (not shown). The primary winding 1 of the ignition coil 2 is connected, on the one hand, to the supply voltage $U_B$ and, on the other hand, via the collector-emitter path of the ignition transistor 3 and a resistor 4 to ground. A load, represented here in the equivalent circuit diagram by the parallel connection of a capacitor 6 and a resistor 7, acts upon the secondary winding 5 of the ignition coil 2. To detect the primary voltage, a tap 8 is provided between the primary winding 1 and the ignition transistor 3, so that the primary voltage $U_P$ is evaluated in an evaluation unit 9, the rise characteristic of the primary voltage $U_P$ being a measure for the secondary load when an ignition pulse is triggered. An additional tap 14 between the primary winding and the ignition transistor 3 is run via a resistor 10 and a Zener diode 11 to the control input of a transistor 12. The collector of the transistor 12 is run via a resistor 15 to a 5-volt supply voltage, while the emitter of the transistor 12 is run to a connection between a control terminal 13 for the ignition signal and the control input of the ignition transistor 3. A third transistor 16 is run on the collector side to the connection between the resistor 10 and the Zener diode 11 and is connected to ground on the emitter side. The control input of this third transistor 16 is connected to the evaluation unit 9.

The above-described ignition system has the following mode of operation. The ignition transistor 3 is initially forced by the control terminal 13 into the conducting state, so that the primary winding 1 of the ignition coil 2 is traversed by current flow. At the end of the signal at the control terminal 13, the ignition transistor 3 attains the non-conducting state, which results in an interruption of the current flow in the primary winding 1 of the ignition coil 2 and, in dependence upon this, in a high-voltage surge in the secondary winding 5. This would then lead on the secondary side to an ignition spark on a spark plug (not shown). Now, if the voltage exceeds the permissible value when the ignition transistor makes the transition into the non-conducting state, then the voltage at the Zener diode 11 breaks through, and a control current is applied to the control input of the transistor 12, so that a control current at the ignition transistor 3 again makes this transistor somewhat permeable to current. As a result, the voltage across the contact-break distance of the ignition transistor 3 drops again immediately and, in fact, continues to drop until the voltage at the Zener diode 11 falls below the breakdown voltage of this Zener diode. This is a generally known voltage bracketing of the ignition transistor 3, the primary voltage $U_P$, which the Zener diode 11 functions in response to, being described as bracketing voltage. At the tap 8, the primary voltage $U_P$ is acquired in the evaluation unit 9 and evaluated such that the voltage building up at the Zener diode 11 can be varied by triggering the transistor 16, i.e., the transistor 16, together with the resistor 10, forms an adjustable voltage divider, the voltage being applied to the middle of the adjustable voltage divider corresponding to the voltage that is applied to the Zener diode 11. The electric potential being applied to the Zener diode is varied in dependence upon the triggering of the transistor 16. For this purpose, primarily the rise time tr of the primary voltage $U_P$ is evaluated up to a specified value in the evaluation unit 9. Thus, a large capacitive load on the secondary side results in a longer rise time tr than in the case of a small capacitive load. When there is a long rise time tr, thus in the case of a high capacitive load, the transistor 16 is powered up with a correspondingly large voltage, and the electric potential acting on the Zener diode 11 is reduced. Contrary to this, in the case of a low load of the transistor 16, it is powered up to a correspondingly lesser extent, so that the Zener diode 11 reaches the breakdown voltage considerably earlier than in the case of a high capacitive load.

FIG. 2 depicts the relationship between the secondary load and the rise time tr of the primary voltage. The table in FIG. 2 is divided into two sections; part a) for larger loads in the secondary electric circuit and part b) for smaller loads. These sections are distinguished in that in each case two different loads were used for the measurement. The table illustrates the rise time tr, which corresponds to the time of the rise of the primary voltage from 0 to 200 V, the voltage change $dU_1$ (during 25 μs), and the voltage change $dU_2$ (during 50 μs). It can clearly be inferred from this table in FIG. 2 that in the case of the load illustrated in part a) of the table (compare the values at C-6 and R-7), a substantially longer rise time tr elapses until 200 volts primary voltage are reached than elapses in the case of the load illustrated in part b) of the table. Thus, one can clearly recognize that a direct correlation exists between the rise time and the secondary load. This correlation is evaluated in the evaluation unit 9, and the transistor 16 is triggered accordingly.

Another possibility for detecting the secondary load is given in that after a specifiable time (for example 25 μs or 50 μs), the voltage change $dU_P$ is detected by the evaluation unit 9. It is also apparent here from FIG. 2 that the electric potential in part b) of the table is substantially greater after the same time, given a smaller load, than the electric potential in part a) of the table.

Figure 3:
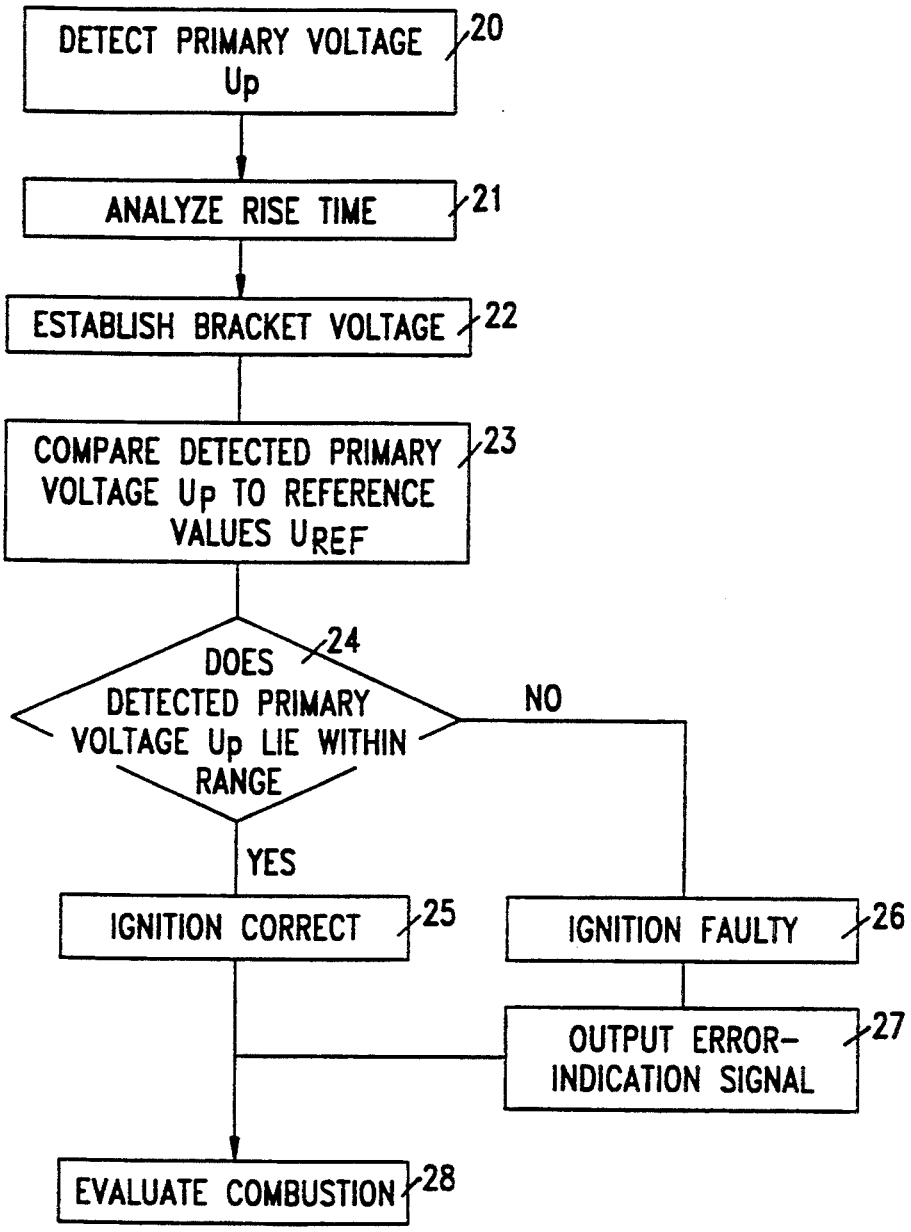
FIG. 3 shows a flow-chart for detecting and evaluating the primary voltage.

FIG. 3 shows one possible way to evaluate the detected primary voltage $U_P$. Thus, the primary voltage $U_P$ is detected in one work step 20, as already described for FIG. 1, either the rise time tr until 200 V primary voltage $U_P$ are reached or the attained primary voltage $U_P$ being capable of being evaluated after a specifiable time. In the subsequent work step 21, the detected primary voltage $U_P$ is evaluated as a measure for the acting secondary load, in that, for example, the rise time until 200 V are reached is analyzed, and in the work step 22, the bracket voltage as described for FIG. 1, is established through an appropriate triggering of the transistor 16.

In the work step 23, the detected primary voltage is compared to reference values $U_{REF}$ of the spark duration and/or of the spark voltage characteristic. At this point, it is checked in the query 24 whether the detected quantities lie within the range of the specifiable limiting values $U_{REF}$. If this is the case, then the evaluated ignition is recognized as being correct in work step 25. A no in response to question 24 leads to the work step 26, in which the ignition that has taken place is evaluated as being faulty, it being possible at the same time, to subdivide the faults into different types of faults on the basis of the evaluated spark voltage. Thus, from the lack of an overshoot when the voltage breaks through, or rather from a flat voltage rise, one can infer shunt firings on the spark plug. At this point, an error-indication signal is output in work step 27, and the combustion that follows is evaluated in the work step 28. Given too small a rise in the primary voltage and the inference that possible shunt firings exist, for example, the evaluation unit 9 of FIG. 1 enables the secondary voltage supply to be increased through an appropriate bracketing $U_{KL}$, in order to thus effect a self-cleaning of the spark plug.

We claim:

1. An ignition system for internal combustion engines comprising:

an ignition coil having a primary winding and a secondary winding of the ignition coil;

an evaluation unit coupled to a primary voltage of the primary winding;

an ignition output stage coupled to the primary winding of the ignition coil and to an output of the evaluation unit, the ignition output stage including a voltage bracketing circuit, the voltage bracketing circuit establishing a bracketing voltage, the bracketing voltage controlling a primary current flowing through the primary winding as a function of the primary voltage at the primary winding and the output of the evaluation unit;

the evaluation unit determining whether a secondary load of the ignition coil is a high secondary load or a low secondary load based upon the primary voltage, the evaluation unit inducing a high bracketing voltage if the secondary load is determined to be the high secondary load, the evaluation unit inducing a low bracketing voltage if the secondary load is determined to be the low secondary load.

2. The ignition system according to claim 1, wherein the evaluation unit monitors a rise time of the primary voltage to determine whether the secondary load of the ignition coil is the high secondary load or the low secondary load.

3. The ignition system according to claim 1, wherein the evaluation unit monitors a time between a point of ignition and an attainment of a predetermined voltage threshold in the primary winding to determine whether the secondary load of the ignition coil is the high secondary load or the low secondary load.

4. The ignition system according to claim 1, wherein, at a predetermined time after a point of ignition, the evaluation unit monitors the primary voltage to determine whether the secondary load of the ignition coil is the high secondary load or the low secondary load.

5. The ignition system according to claim 1, wherein the evaluation unit compares the primary voltage to a reference value corresponding to at least one of a spark duration reference value and a spark voltage characteristic reference value to determine whether a proper combustion has occurred.

6. The ignition system according to claim 5, wherein the evaluation unit identifies a faulty combustion and outputs an error-indication signal when the primary voltage deviates from the reference value.

* * * * *